US008226195B2

(12) United States Patent
Uchida

(10) Patent No.: US 8,226,195 B2
(45) Date of Patent: Jul. 24, 2012

(54) INKJET RECORDING APPARATUS

(75) Inventor: Shuuhei Uchida, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 282 days.

(21) Appl. No.: 12/640,305

(22) Filed: Dec. 17, 2009

(65) Prior Publication Data

US 2010/0165030 A1 Jul. 1, 2010

(30) Foreign Application Priority Data

Dec. 27, 2008 (JP) ..... 2008-335474

(51) Int. Cl.
*B41J 29/38* (2006.01)

(52) U.S. Cl. ..... 347/14; 347/15; 347/19

(58) Field of Classification Search ..... 347/14, 347/19, 15

See application file for complete search history.

(56) References Cited

U.S. PATENT DOCUMENTS 5,359,355 A * 10/1994 Nagoshi et al. ..... 347/9
2006/0092198 A1* 5/2006 Conca et al. ..... 347/9

FOREIGN PATENT DOCUMENTS

JP 05-57965 A 3/1993

* cited by examiner

*Primary Examiner* — Laura Martin
(74) *Attorney, Agent, or Firm* — Canon USA, Inc., IP Divison

(57) ABSTRACT

On a region of a recording medium that is scanned by overlapping portions of overlapping heads a plurality of times, an image is recorded in at least one scan, without using ejection nozzles in one nozzle array corresponding to the overlapping portions of the overlapping heads and by using ejection nozzles in the other nozzle array corresponding to the overlapping portions.

7 Claims, 9 Drawing Sheets

INKJET RECORDING APPARATUS

BACKGROUND OF THE INVENTION

1. Field of the Invention

The present invention relates to an inkjet recording apparatus for performing so-called multipass recording, with which an image is recorded on a unit region of a recording medium while a recording head passes over the unit region a plurality of times.

2. Description of the Related Art

In recent years, office automation equipment such as personal computers, copiers, and word processors has become widespread. In order to record images formed by the office automation equipment, recording apparatuses such as inkjet recording apparatuses are used.

An inkjet recording apparatus includes a recording head having a large number of nozzle arrays arranged therein. Each of the nozzle arrays includes ejection nozzles for ejecting ink, which are densely arranged in one direction. This structure is adopted in order to reduce recording time and improve definition of a recorded image. For the purpose of recording a color image, a recording head having inks of different colors and nozzle arrays each corresponding to a color of ink is used.

It is known that, when an inkjet recording apparatus performs recording, the ejection characteristics of a recording head affect recording quality. The accuracy of ejection from the ejection nozzles is affected by even a slight deviation in a manufacturing process of a recording head, which leads to a deviation in the ejection characteristics of the recording head, such as the amount and the direction of ejection from the ejection nozzles. A deviation in the ejection characteristics of the ejection nozzles makes the density of a recorded image uneven and causes degradation of recording quality.

Multipass Printing

In order to reduce the degradation of recording quality, multipass recording has been used. Multipass recording is performed by repeating the process of making a recording head scan a recording medium in a main scanning direction and conveying the recording medium in a sub-scanning direction. In each scan, recording is performed while changing a dividing pattern using a mask or the like. A recording medium is conveyed by a distance shorter than the length of the recording head in the sub-scanning direction. Recording is performed on a region of the recording medium while the region is scanned a plurality of times using different ejection nozzles. With multipass recording, recording is performed in a complimentary manner using ejection nozzles having different ejection characteristics, whereby degradation of recording quality can be reduced.

Connected Heads

In order to increase the recording speed of multipass recording, methods of increasing the width of recording per one scan in the main scanning direction have been used. For example, recording heads have been elongated so as to increase the number of ejection nozzles for one color arranged in the recording heads. That is, nozzle arrays have been elongated in the sub-scanning direction. However, due to technical problems and an increase in cost, it has become difficult to further elongate recording heads in a chip form. Thus, a method of connecting together a plurality of recording heads for one color in the sub-scanning direction has been adopted.

However, when recording heads are connected to one another, disposition of recorded pixels formed on a recording medium may be disturbed by deviation of the installation position of the recording heads and individual differences between the recording heads, which may make image defects such as white lines and black lines conspicuous. Therefore, in an existing technique, a plurality of recording heads are connected to one another in an overlapping manner so that adjacent two recording heads have overlapping portions, and image data is divided between nozzles in the overlapping portions of the two recording heads (see Japanese Patent Laid-Open No. 05-57965).

However, when multipass recording is performed using the overlapping heads having the overlapping portions, if a recording medium is conveyed by a certain distance, the overlapping portions may be used for a recording region a plurality of passes in an overlapping manner. For example, if the multipass recording is performed in N passes, since an image is divided for the overlapping portions in two passes using an overlap dividing mask, a region may exist on which the image is recorded with practically N+1 to 2N passes. If such a region exists, the density of an image in the region is higher that of a region on which an image is recorded with N passes without using the overlapping portions. As the difference in the number of passes becomes larger, the difference in density becomes larger, whereby degradation of an image occurs. In particular, when sub-scanning is performed by a distance (sub-scanning distance) smaller than the width of the overlapping portions (also referred to as "overlapping width"), the overlapping portions are used more frequently and such regions are formed continuously, whereby image degradation becomes conspicuous.

SUMMARY OF THE INVENTION

The present invention provides an inkjet recording apparatus that controls which ejection nozzles in overlapping portions are to be used when performing recording on a region for which the overlapping portions are used a plurality of times, thereby suppressing degradation of an image.

According to the present invention, an inkjet recording apparatus includes a scanning unit that makes a recording head scan a recording medium in a scanning direction, the recording head including a first nozzle array and a second nozzle array arranged in a predetermined direction that intersects the scanning direction such that end portions of the first and second nozzle arrays overlap in the scanning direction, each of the first and second nozzle arrays including a plurality of ejection nozzles for ejecting ink, the plurality of ejection nozzles arranged in the predetermined direction; and a determination unit that determines, when recording an image in a region of the recording medium that is scanned a plurality of times by an overlapping portion of the first and second nozzle arrays of the recording head, which ejection nozzles of the recording head are to be used so that an image can be recorded in at least one scan, by using ejection nozzles in the second nozzle array corresponding to the overlapping portion and without using ejection nozzles in the first nozzle array corresponding to the overlapping portion, the ejection nozzles being in the overlapping portion of the recording head facing the region.

Since the inkjet recording apparatus controls which ejection nozzles are to be used when performing recording on the region for which the overlapping portions are used a plurality of times, the inkjet recording apparatus is capable of suppressing degradation of an image and thereby recording a high-quality image.

Further features of the present invention will become apparent from the following description of exemplary embodiments with reference to the attached drawings.

DESCRIPTION OF THE EMBODIMENTS

First Embodiment

Figure 1:
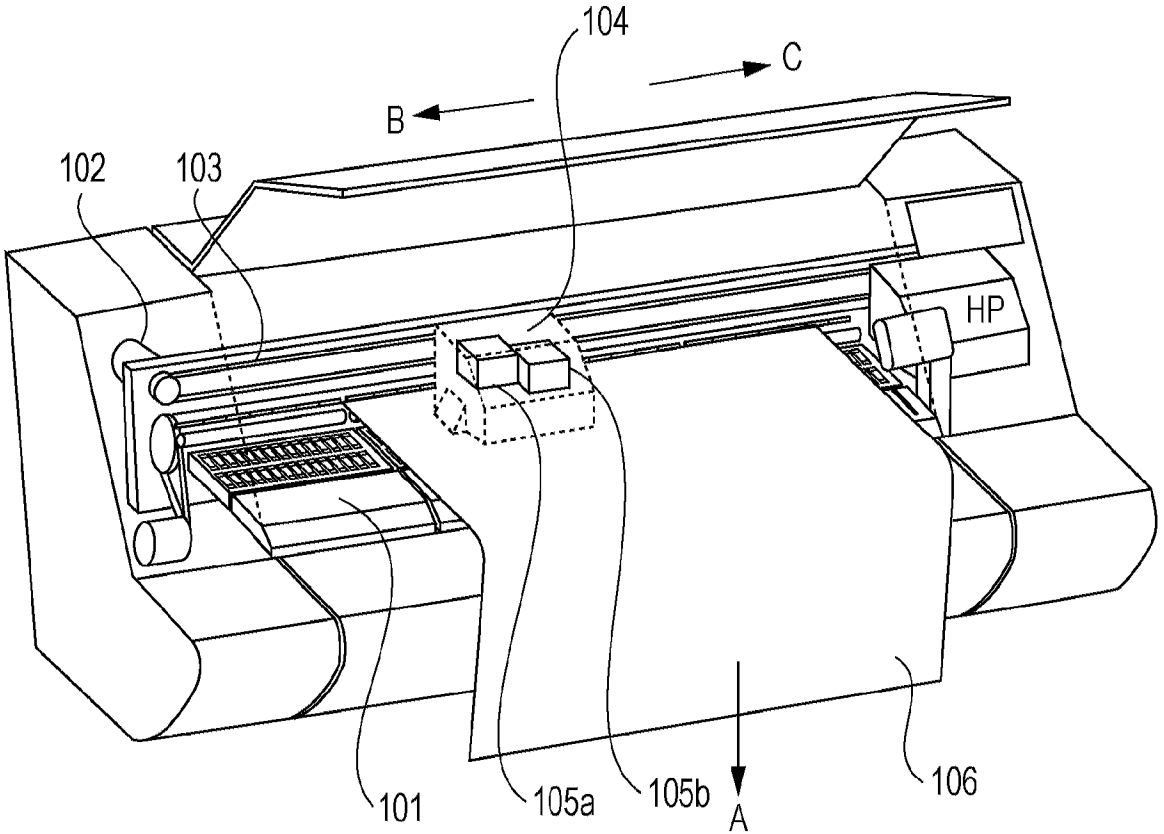
FIG. 1 is a perspective view of an inkjet recording apparatus.

A first embodiment according to the present invention is described. FIG. 1 is a perspective view of an inkjet recording apparatus.

The inkjet recording apparatus includes a platen 101 on which a recording medium 106 is placed. The recording medium 106 is conveyed in a sub-scanning direction (indicated by arrow A), which is predetermined. Above the platen 101, two scanning rails (not shown) extend parallel to the platen 101. A carriage 104 is attached to the scanning rails via a slide bearing (not shown). Driven by a motor 102 and a belt 103, the carriage 104 reciprocates backwards (the direction of arrow C) and forwards (the direction of arrow B) in a main scanning direction that intersects the sub-scanning direction. A plurality of recording heads (a first recording head 105*a* and a second recording head 105*b*) are attached to the carriage 104. The recording heads can be replaced independently.

The recording heads 105*a* and 105*b* are inkjet heads that eject ink droplets by forming bubbles using heat generated by an electric thermal conversion member (heater). Each of the recording heads includes eight nozzle arrays in four pairs, each pair for cyan (C), magenta (M), yellow (Y), and black (BK). Each of the recording heads includes 600 ink ejection nozzles. An upper half of an image is recorded with one scan (also referred to as "pass") using the heads C1, M1, Y1, and BK1 of the recording head 105*b*. A lower half of the image is recorded with one scan using the heads C2, M2, Y2, and BK2 of the recording head 105*a*.

As described above, among the 600 ejection nozzles in the nozzle arrays of each of the first and second recording heads 105*a* and 105*b*, twelve ejection nozzles overlap one another in overlapping portions of the ejection heads. That is, 588 ejection nozzles in each of the recording heads do not overlap. Since the two heads have 1200 ejection nozzles, 1188 lines of images are recorded in the sub-scanning direction with one scan.

Figure 2:
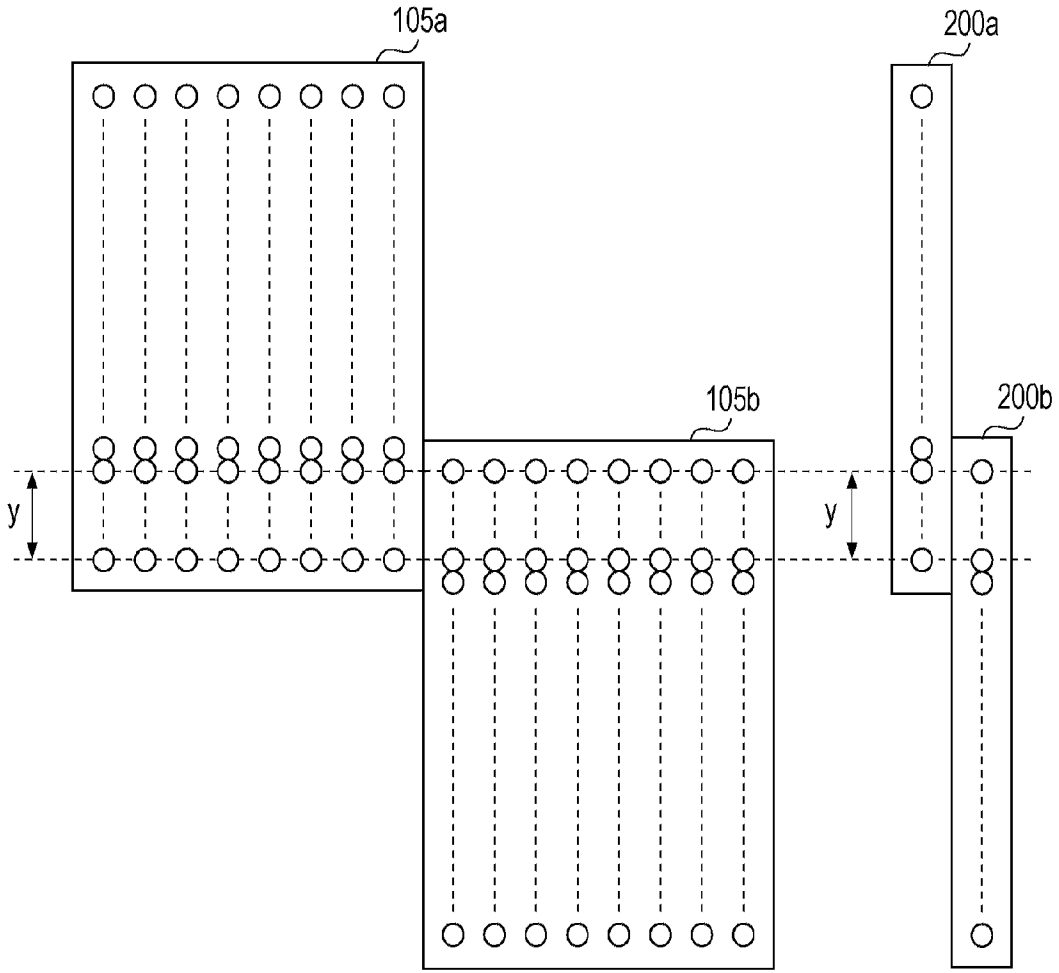
FIG. 2 illustrates the disposition of nozzle arrays of recording heads that overlap each other.

FIG. 2 illustrates an example in which the two recording heads 105*a* and 105*b* are disposed in an overlapping manner. As described above, eight nozzle arrays are arranged in each of the recording heads 105*a* and 105*b*. A region y, which is indicated by double-headed arrows in FIG. 2, includes ejection nozzles corresponding to the overlapping portions of the recording heads. The number of such ejection nozzles is twelve in the present embodiment. Assuming that a corresponding pair of a first nozzle array 200*a* and a second nozzle array 200*b* are extracted from the overlapping heads, control of the use of ejection nozzles in the overlapping portions is described below by using the pair of nozzle arrays 200*a* and 200*b*.

Figure 3:
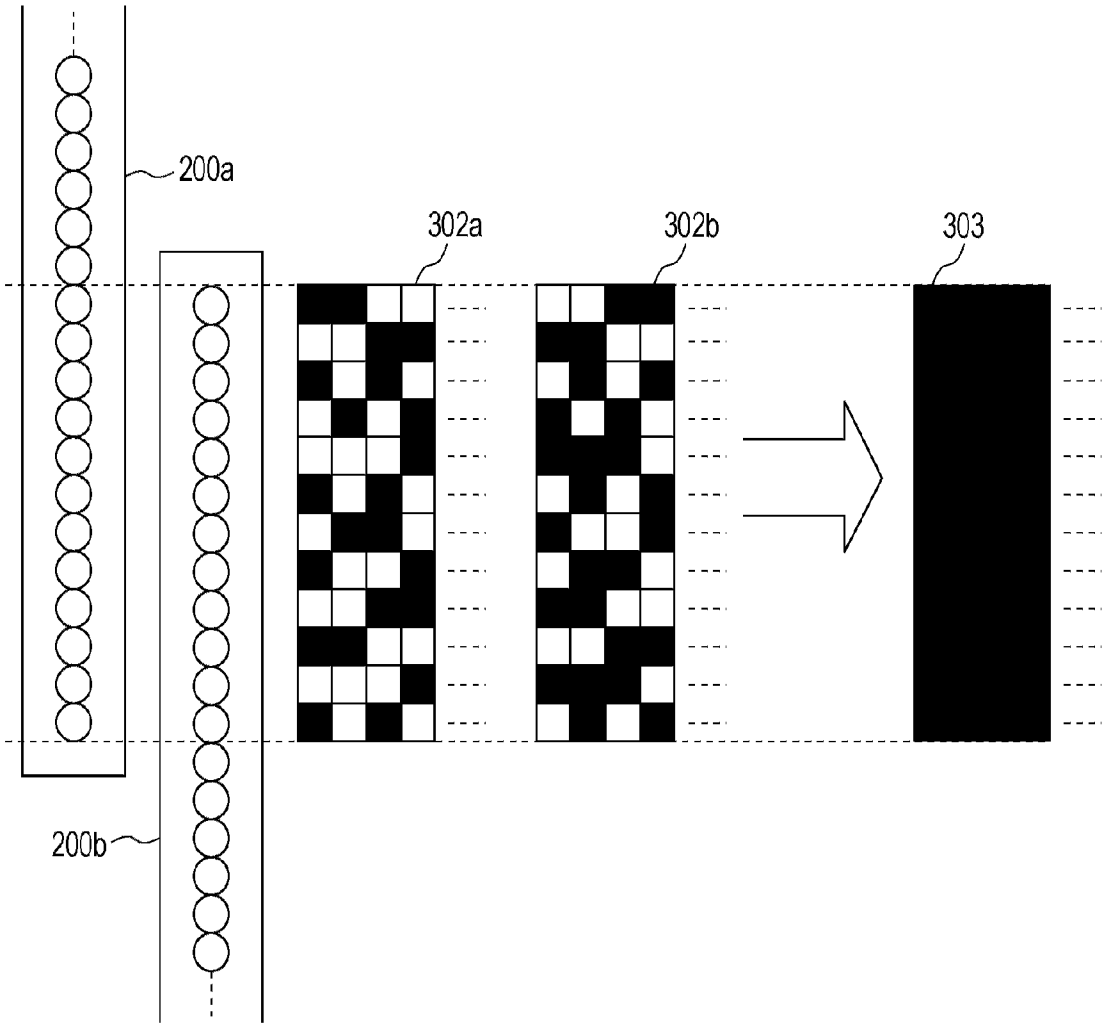
FIG. 3 is a schematic view of an overlap dividing mask.

FIG. 3 illustrates image data divided among ejection nozzles in the overlapping portions. Overlap dividing masks 302*a* and 302*b* having dividing patterns are used for the ejection nozzles of the first and second nozzle arrays 200*a* and 200*b* in the overlapping portions, respectively. The overlap dividing masks are complimentary. When superposed, these masks complement each other 100% as illustrated as a mask 303. When performing multipass recording, image data for one pass corresponding to the ejection nozzles in the overlapping portions is divided using the overlap dividing mask, and an image for the image data is recorded using the nozzle arrays in two recording heads. Thus, image data to be recorded can be divided among a plurality of passes independent of a dividing pattern used for multipass recording.

Figure 4:
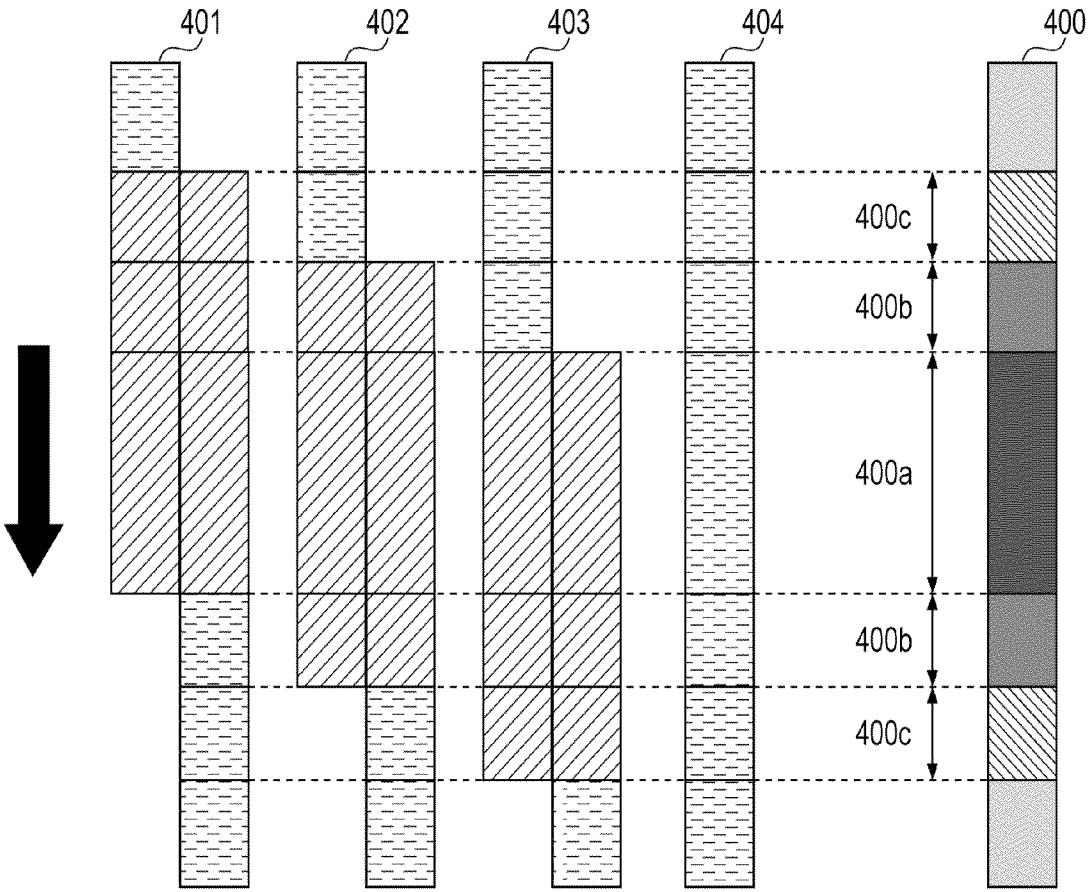
FIG. 4 illustrates a comparative example for which the present invention is not used.
Figure 5:
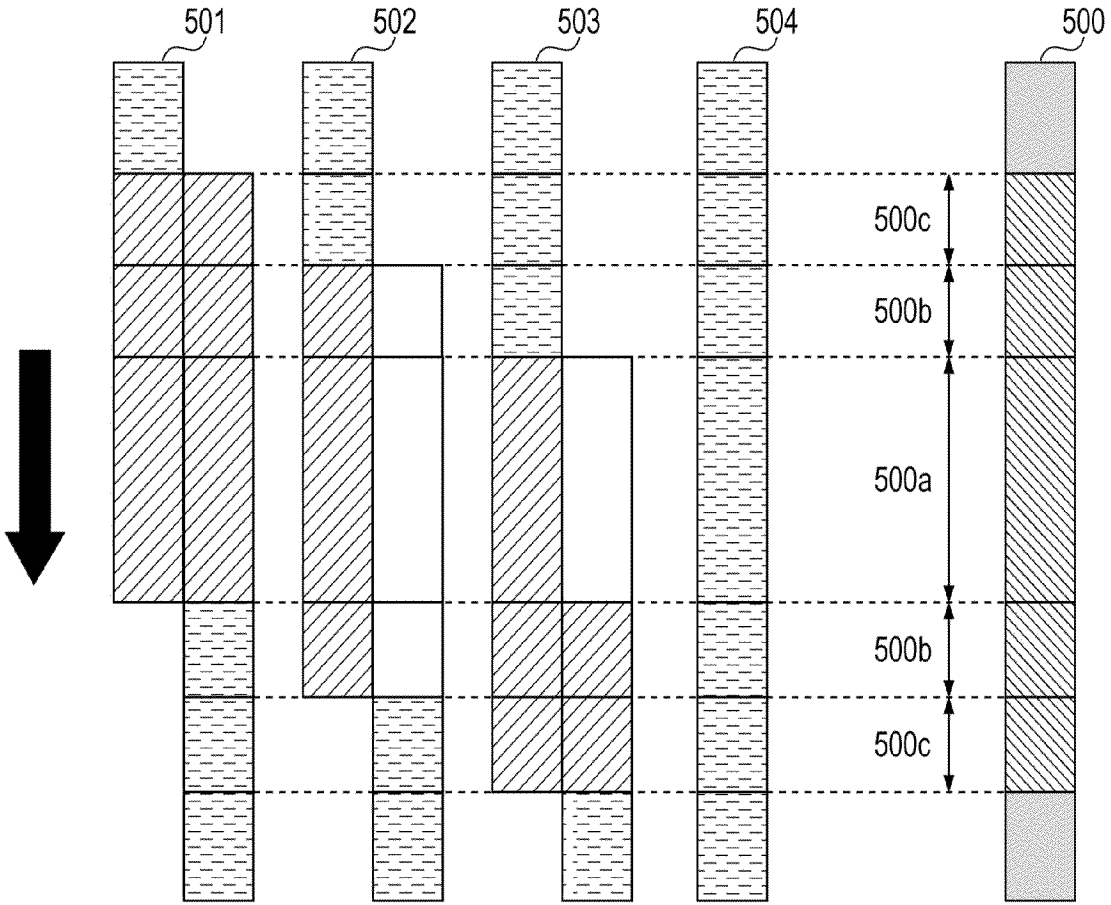
FIG. 5 illustrates control and a recording result of recording heads of a first embodiment.

Next, control of ejection nozzles in the overlapping portions of the two recording heads, which characterizes the present embodiment, is described. FIGS. 4 and 5 illustrate relative positions of the overlapping recording heads in each pass of four-pass recording and recording results. In FIGS. 4, regions 400*a* to 400*c* are regions that are scanned by the overlapping portions with one, two, and three passes, respectively, of the four-pass recording and not scanned with the remaining passes. The same applies to regions 500*a* to 500*c* in FIG. 5. A recording medium is conveyed in directions indicated by arrows in FIGS. 4 and 5. In the present embodiment, the recording medium is conveyed between the first and second passes by a distance shorter than the distance between the third and fourth passes.

FIG. 4 illustrates a comparative example for which the present invention is not used. The recording heads are in relative positions 401, 402, 403, and 404 in the first to fourth passes of the four-pass recording, respectively. A recording result 400 is obtained after the four-pass recording has been performed. The regions 400*a*, 400*b*, and 400*c* are regions scanned and recorded by the overlapping portions. Regions shaded with diagonal lines in the relative positions 401 to 404 of the recording heads indicate the overlapping portions of the recording heads. Regions shaded with horizontal broken lines indicate non-overlapping portions.

As described above, image data to be recorded by the overlapping portions is divided between two passes using the overlap dividing mask. The region 400*a* shown in FIG. 4 is recorded by the overlapping portions with three recording scans in the four-pass recording. Including the three overlapping passes, the region 400*a* is recorded with practically seven passes. Likewise, the region 400*b* is recorded with practically six passes including two overlapping passes. The region 400*c* is recorded with practically five passes including one overlapping pass.

As described above, when N-pass recording is performed using overlapping heads, an image recorded in a region that is scanned a plurality of times by the overlapping portions has a density higher than an image recorded in a region that is scanned with N passes without using the overlapping portions. As the number of times the overlapping portions are used increases, the difference in density between the region scanned by the overlapping portions and the region recorded with N passes becomes larger.

FIG. 5 illustrates relative positions of the recording heads of the present embodiment and a recording result. As in FIG. 4, the recording heads are in relative positions 501, 502, 503, and 504 in the first to fourth recording scans of four-pass recording, respectively. A recording result 500 is obtained after the four-pass recording. In FIG. 5, white regions of the recording heads in the relative positions 502 and 503 include ejection nozzles that are not used for recording, which are described below.

The region 500*a* of the recording result shown in FIG. 5 is scanned by the overlapping portions with three passes. An image data to be recorded by the overlapping portions is divided using the overlap dividing mask. That is, a first combination that uses ejection nozzles in two recording heads is used when the recording heads are in the relative positions 501 in 503 (partial). On the other hand, when the recording heads are in the relative position 502, the overlap dividing mask is not used for the overlapping portions, and recording is performed by using a second combination that uses ejection nozzles in one recording head and does not use ejection nozzles in the white region of the other recording head illustrated in FIG. 5. Which ejection nozzles are to be used is controlled by a controller, which is a recording control unit (not shown). Thus, the regions 500*a* and 500*b*, for which the overlapping portions are used a plurality of times in an overlapping manner, are recorded with practically five passes. Therefore, a high-density region shown in FIG. 4 does not appear in the recording result.

Figure 9:
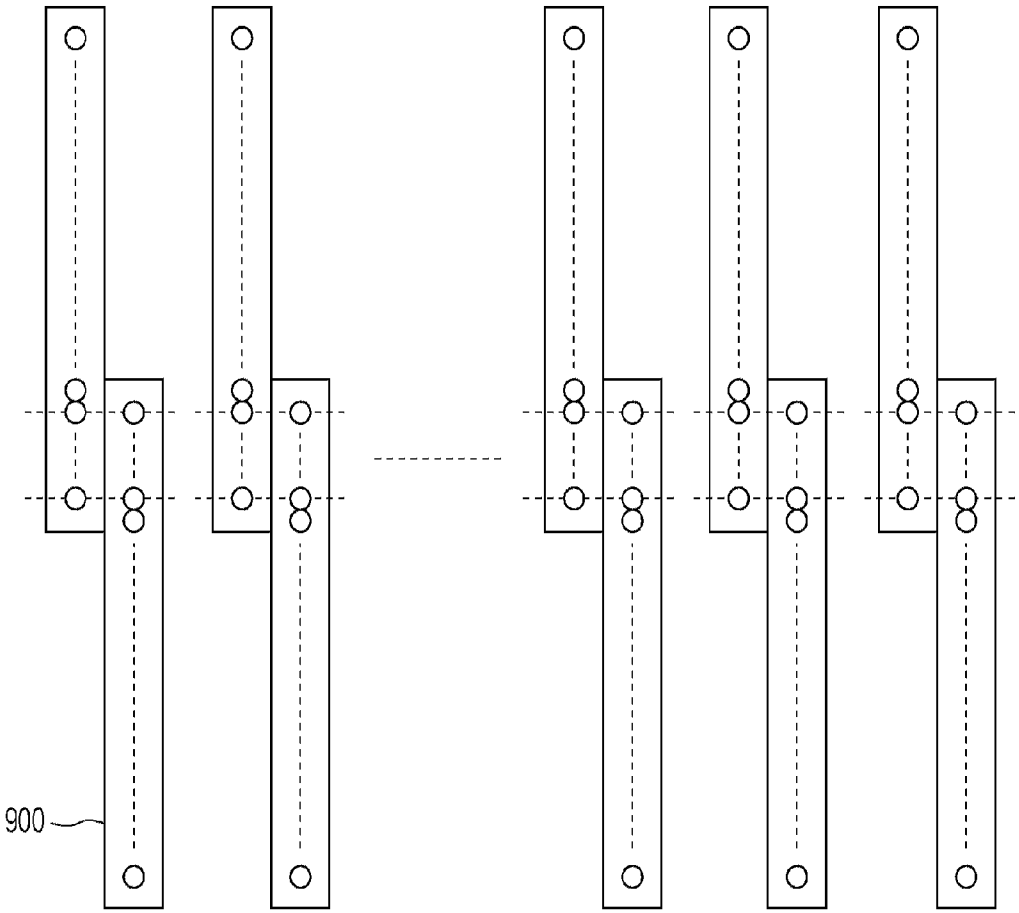
FIG. 9 illustrates an example of a configuration of the recording heads of the first embodiment.

Regarding the present embodiment, the nozzle arrays 200*a* and 200*b* for the same color in respective recording heads 105*a* and 105*b*, each of the recording heads including a plurality of nozzle arrays for a plurality of colors, have been described. As illustrated in FIG. 9, an embodiment of the present invention may be configured such that one of the recording heads 900 has an nozzle array for a single color and each of the other recording heads has an nozzle array for a different color. It is preferable that the number of ejection nozzles in each of the overlapping portions be in the range of about one to three percent of the number of ejection nozzles in an nozzle array. In the present embodiment, twelve ejection nozzles, which is two percent of 600 ejection nozzles of an nozzle array, are in each of the overlapping portions.

In the present embodiment, for a region that the overlapping portions scan a plurality of times, an overlap dividing mask is not used in at least one recording scan. That is, for this region, recording is performed using one recording head without dividing image data. By thus reducing the number of passes for recording in a region that the overlapping portions scan a plurality of times, a difference between the number of passes for the region and the number of passes for a region that the overlapping portions do not scan a plurality of times is reduced. Therefore, a difference in the density of an image is reduced and degradation of quality of the image is suppressed.

Second Embodiment

Next, a second embodiment of the present invention is described.

In the first embodiment, for regions that the overlapping portions scan a plurality of times, which ejection nozzles are to be used is controlled so as to reduce the number of passes with which recording is actually performed when the recording heads are in the relative positions 502 and 503. Thus, since the regions 500*a* to 500*c* are recorded with N+1 passes, a difference in density is reduced as compared with a case when the control is not performed, whereby degradation of an image is suppressed. However, in a scan when the recording heads are in the relative position 502, there is no region in which an image is recorded by using overlapping portions of the two recording heads. Thus, at the boundary between regions for which respective heads are used, degradation of an image, such as black lines or white lines may occur.

Figure 6:
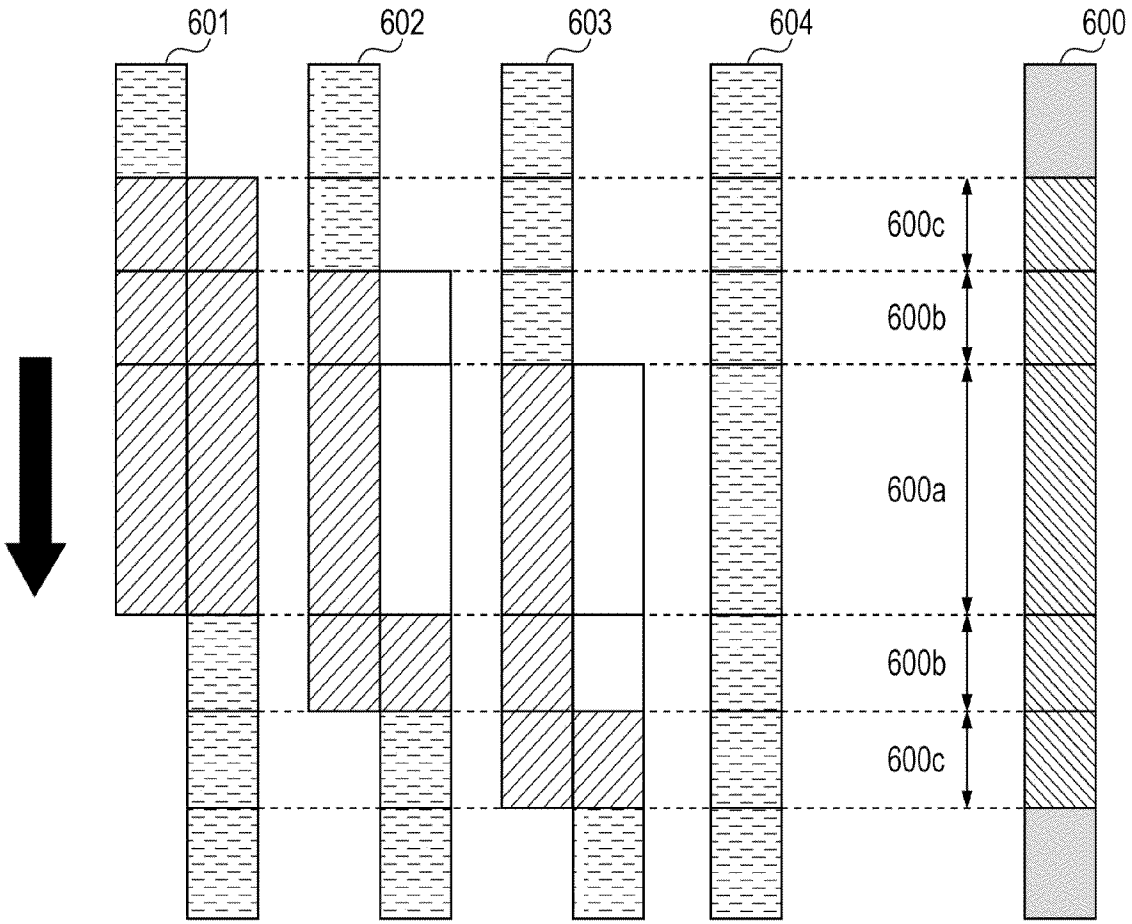
FIG. 6 illustrates control and a recording result of recording heads of a second embodiment.

Regarding the problem, FIG. 6 illustrates relative positions of overlapped recording heads of the second embodiment and a recording result. For each of four scans corresponding to the relative positions 601 to 604 of the recording heads, a recording medium is conveyed in the same manner as in FIGS. 4 and 5. Overlapping portions are used in scans corresponding to relative positions 601, 602, and 603 of the recording heads.

In a scan corresponding to the relative position 601 of the recording heads, an image data is divided among ejection nozzles in the overlapping portions, and a first combination that uses ejection nozzles in two recording heads is used. In scans corresponding to the relative positions 602 and 603 of the recording heads, a part of a region recorded by the overlapping portions is recorded with the first combination that uses ejection nozzles in two recording heads, and the remaining part of the region is recorded with a second combination that uses ejection nozzles in only one recording head. Thus, for each of the three scans using the overlapping portions for recording, a region exists in which recording is performed by using two recording heads. Therefore, while reducing the number of overlapping recording passes, generation of lines at an overlapping portion of the heads is suppressed.

In this way, when using the overlapping heads, a region recorded by the overlapping portions are divided into a region recorded by two recording heads and a region recorded by one recording head, and control is performed such that a region recorded by two recording heads exists in each scan and such regions do not overlap one another. As a result, the number of passes with which recording is performed in an overlapping manner is reduced, so that a difference in density is suppressed and generation of lines at an overlapping portion of the recording heads is suppressed.

Third Embodiment

Figure 7:
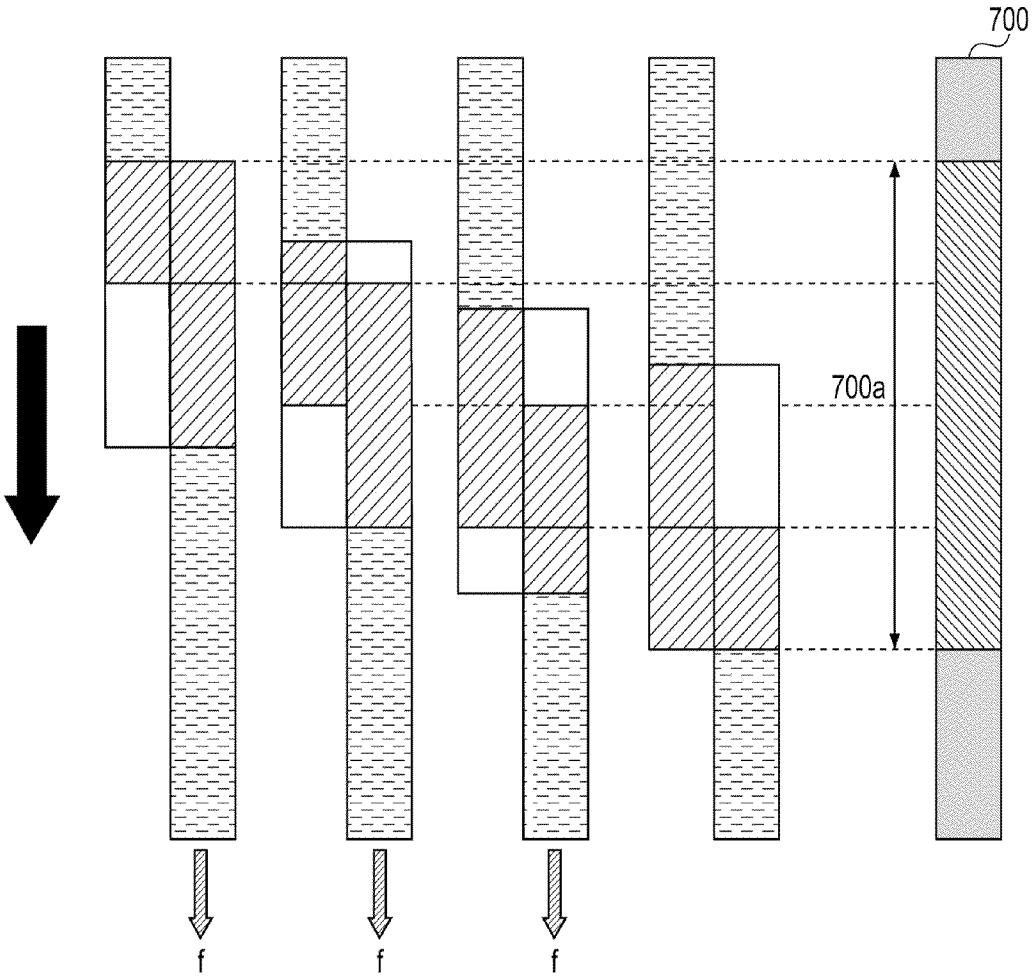
FIG. 7 illustrates control and a recording result of recording heads of a third embodiment.

Next, referring to FIG. 7, a third embodiment is described. Control of ejection nozzles in the overlapping portions when a recording medium is conveyed by a small distance, such as when recording is performed on an end portion of a recording medium, is described.

FIG. 7 illustrates four-pass recording similar to that for the embodiments described above. A recording medium is conveyed by a small distance f. A region 700 is a region where the overlapping portions is used at least once. The length 700*a* of the region 700 is $y+3\times f$, where y is the length of the overlapping portions. For a region having the length $y+3\times f$, data is divided using an overlap dividing mask or the like, and recording is performed on regions each having a length of $(y+3\times f)/4$ using both recording heads. That is, for a region where the overlapping portions are used a plurality of times, recording is performed by using ejection nozzles in two recording heads in one pass and by using ejection nozzles in only one recording head in the remaining three passes for the same raster, so that recording is performed with practically five passes. Thus, as described above regarding the second embodiment, recording can be controlled such that a region recorded by using two recording heads exists for each scan and such regions do not overlap one another.

Therefore, when performing N-pass recording, the length of a region where the overlapping portions is used at least once is $y+(N-1)\times f$, and a region having a length of $\{y+(N-1)\times f\}/N$ is to be recorded in one pass using two recording heads. Moreover, if the length per one pass is made smaller than $\{y+(N-1)\times f\}/N$ and an interval is provided so as to prevent the regions from becoming continuous, no region is recorded with N+1 or more passes, whereby degradation of an image due to a difference in density is further suppressed.

Other Embodiments

Figure 8:
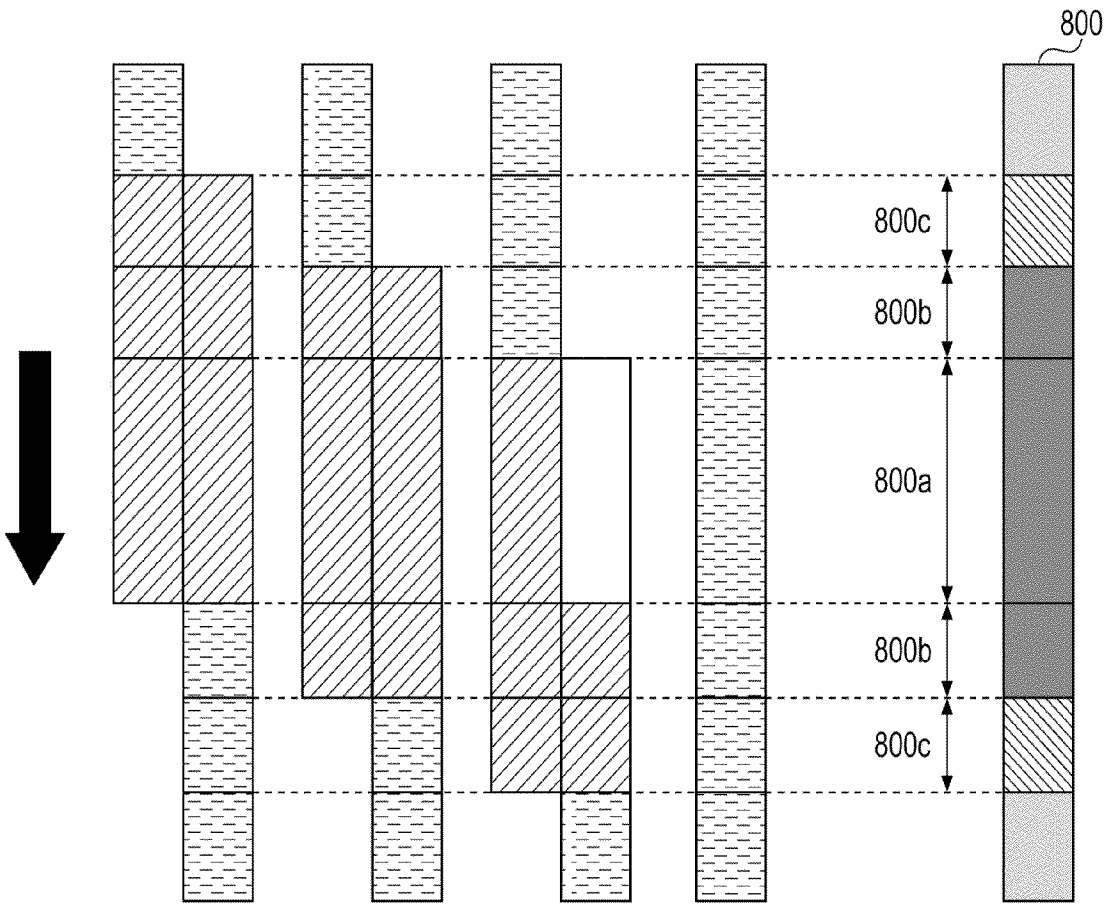
FIG. 8 illustrates control and a recording result of recording heads of another embodiment.

Next, other embodiments are described. In the first to third embodiments, when performing multipass recording with which recording is performed while a recording head scans a recording medium N times, ejection nozzles in the overlapping portions are controlled such that a region that the overlapping portions scan a plurality of times in an overlapping manner is recorded with practically N+1 passes. However, the present invention is not limited to the embodiments. With the present invention, by reducing the number of passes used for recording a region scanned by the overlapping portions, a difference between the number of recording passes for the region and the number of passes for a region that is not scanned by the overlapping portions is reduced. Thus, a difference in the density of an image is reduced. The number of the recording passes is not limited to N+1. For example, although regions 800*a* and 800*b* shown in FIG. 8 are recorded with practically N+2 passes, as compared with the region 400*a* in the comparative example shown in FIG. 4, the density of the region 800*a* in FIG. 8 is reduced. Thus, degradation of an image is suppressed. Moreover, when performing multipass recording, the overlapping portions may not be used at all for a region scanned by the overlapping portions a plurality of times. That is, for each scan performed by the overlapping portions, only one of two nozzle arrays in the overlapping portions may be used for recording.

In the first to third embodiments, the length of regions of the two recording heads including ejection nozzles used for recording are the same for each scan of the multipass recording. However, the lengths are not particularly limited. For example, the lengths may be uneven or may be controlled for each raster.

In the above-described embodiments, the positions of the ejection nozzles in the overlapping portions are the same with respect to the main scanning direction. However, the positions of the ejection nozzles in one recording head may be staggered from those of the ejection nozzles in the other recording head.

In the above-described embodiments, the sub-scanning direction, which is a first direction, and the main scanning direction, which is a second direction, are perpendicular to each other. However, it is not necessary that the main scanning direction and the sub scanning direction be perpendicular to each other, and it is sufficient that these directions intersect with each other.

As heretofore described, with the present invention, precise control of sheet conveyance for each ejection nozzle and a high-precision sheet conveyance unit are not necessary. Instead, the recording control unit controls ejection nozzles to be used for recording, whereby degradation of an image at the overlapping portions of the overlapping heads is prevented.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-335474 filed Dec. 27, 2008, which is hereby incorporated by reference herein in its entirety.

What is claimed is:

1. An inkjet recording apparatus comprising:

a recording unit that records an image by making a recording head scan a recording medium a plurality of times, the recording head including a first nozzle array and a second nozzle array overlapping each other and arranged in a predetermined direction that intersects a scanning direction in which the recording head scans a recording medium such that end portions of the first and second nozzle arrays have an overlapping portion that overlaps each other in the scanning direction, each of the first and second nozzle arrays including a plurality of ejection nozzles for ejecting ink, the plurality of ejection nozzles arranged in the predetermined direction; and a determination unit that determines ejection nozzles to be used for recording an image out of ejection nozzles corresponding to the overlapping portion, when recording an image in a region of the recording medium where an image is formed in two or more scans among the plurality of times of scans by using the ejection nozzles corresponding to the overlapping portion, so that an image can be recorded in at least one scan out of the two or more scans by using ejection nozzles both in the first and second nozzle arrays corresponding to the overlapping portion and in at least one scan out of the two or more scans by using the ejection nozzles in the second nozzle array corresponding to the overlapping portion and without using the ejection nozzles in the first nozzle array corresponding to the overlapping portion.

2. The inkjet recording apparatus according to claim 1, wherein a width of the region in the predetermined direction is smaller than a width of the overlapping portion in the predetermined direction.

3. The inkjet recording apparatus according to claim 1, wherein the determination unit determines ejection nozzles to be used so that an image can be recorded, in only one scan out of the two or more scans, by using the ejection nozzles both in the first and second nozzle arrays corresponding to the overlapping portion.

4. The inkjet recording apparatus according to claim 1, wherein the region of the recording medium is a single raster region.

5. The inkjet recording apparatus according to claim 1, wherein the ejection nozzles in the first and second nozzle arrays eject ink of a same color.

6. An inkjet recording apparatus comprising:

a scanning unit that makes a recording head scan a recording medium in a scanning direction, the recording head including an overlapping portion at which end portions of first and second nozzle arrays overlap in the scanning direction, each of the first and second nozzle arrays including a plurality of ejection nozzles for ejecting ink, the plurality of ejection nozzles arranged in a predetermined direction that intersects the scanning direction; and a recording control unit that records an image by performing recording scans using ejection nozzles in the overlapping portion such that a first combination of ejection nozzles and a second combination of ejection nozzles exist, the first combination being a combination with which two ejection nozzles in the overlapping portion corresponding to each other in the scanning direction are used, the second combination being a combination with which only one of the two ejection nozzles is used, wherein the recording control unit determines positions of ejection nozzles to be used such that, for an identical raster of the recording medium, the first combination is used in only one recording scan and the second combination is used in the other recording scans.

7. An inkjet recording method for recording an image by making a recording head scan a recording medium a plurality of times, the recording head including a first nozzle array and a second nozzle array overlapping each other and arranged in a predetermined direction that intersects a scanning direction in which the recording head scans a recording medium such that end portions of the first and second nozzle arrays have an overlapping portion that overlaps each other in the scanning direction, each of the first and second nozzle arrays including a plurality of ejection nozzles for ejecting ink, the plurality of ejection nozzles arranged in the predetermined direction, the inkjet recording method comprising:

determining ejection nozzles to be used for recording an image out of ejection nozzles corresponding to the overlapping portion, when recording an image in a region of the recording medium where an image is formed in two or more scans among the plurality of times of scans by using the ejection nozzles corresponding to the overlapping portion, so that an image can be recorded in at least one scan out of the two or more scans by using ejection nozzles both in the first and second nozzle arrays corresponding to the overlapping portion and in at least one scan out of the two or more scans by using the ejection nozzles in the second nozzle array corresponding to the overlapping portion and without using the ejection nozzles in the first nozzle array corresponding to the overlapping portion; and recording an image in the region by using the determined ejection nozzles.

* * * * *